US009487963B2

(12) United States Patent
Michelon

(10) Patent No.: US 9,487,963 B2
(45) Date of Patent: Nov. 8, 2016

(54) APPARATUS FOR CLEANING SUBMERGED SURFACES WITH A SEMI-AUTOMATIC RETURN COMMAND

(71) Applicant: ZODIAC POOL CARE EUROPE, Paris (FR)

(72) Inventor: Thierry Michelon, Toulouse (FR)

(73) Assignee: ZODIAC POOL CARE EUROPE, Paris (FR)

( * ) Notice: Subject to any disclaimer, the term of this patent is extended or adjusted under 35 U.S.C. 154(b) by 36 days.

(21) Appl. No.: 13/662,716

(22) Filed: Oct. 29, 2012

(65) Prior Publication Data

US 2013/0104321 A1 May 2, 2013

Related U.S. Application Data

(60) Provisional application No. 61/599,051, filed on Feb. 15, 2012.

(30) Foreign Application Priority Data

Oct. 27, 2011 (FR) ..... 11 03274

(51) Int. Cl.
*E04H 4/16* (2006.01)

(52) U.S. Cl.
CPC ..... *E04H 4/1654* (2013.01)

(58) Field of Classification Search
CPC .. E04H 4/1654; E04H 4/1663; E04H 4/1672
USPC ..... 15/1.7; 210/167.1, 167.15, 167.16, 210/167.17, 167.13, 167.19; 700/213–264; 701/23–28; 180/167; 440/1; 114/330, 114/337
See application file for complete search history.

(56) References Cited

U.S. PATENT DOCUMENTS 3,422,478 A * 1/1969 Osborne ..... 15/1.7
4,129,904 A * 12/1978 Pansini ..... 4/490
4,154,680 A * 5/1979 Sommer ..... 210/167.16
5,454,129 A * 10/1995 Kell ..... E04H 4/1654 15/1.7
5,985,156 A * 11/1999 Henkin et al. ..... 210/744

(Continued)

FOREIGN PATENT DOCUMENTS

EP 1122382 A1 * 8/2001 ..... E04H 4/16
EP 2290172 A2 3/2011

(Continued)

OTHER PUBLICATIONS

WO2011038602A1 (machine translation), 2011.*

(Continued)

*Primary Examiner* — Monica Carter
*Assistant Examiner* — Andrew A Horton
(74) *Attorney, Agent, or Firm* — Dean W. Russell; Kilpatrick Townsend & Stockton LLP

(57) ABSTRACT

The invention relates to an automobile apparatus (1) for cleaning surfaces submerged in a basin (2) comprising a driving mechanism, a programmed controlling device for the driving mechanism, a man-machine interface consisting of an input device, and a filter chamber, characterized in that, on activation of a return command button (12), a return setpoint is emitted to the programmed controlling device, which is adapted to inhibit a cleaning program and control the driving mechanism such that it drives the apparatus up to the surface of the water.

10 Claims, 2 Drawing Sheets

(56) References Cited

U.S. PATENT DOCUMENTS

Figure 1:
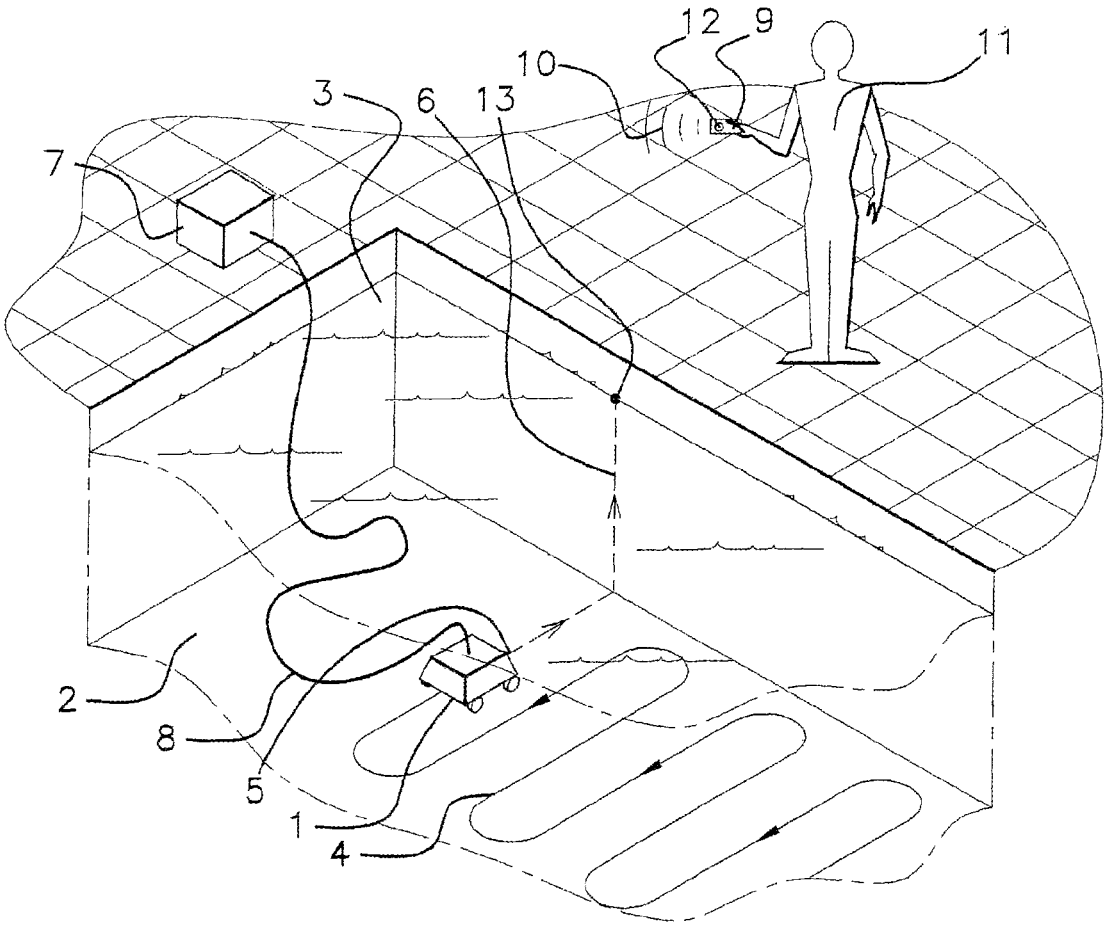

| | | | | |
|---|---|---|---|---|
| 6,099,658 | A * | 8/2000 | Porat | 134/18 |
| 6,155,657 | A * | 12/2000 | Erlich et al. | 305/178 |
| 6,389,329 | B1 * | 5/2002 | Colens | A47L 5/30 180/167 |
| 6,409,916 | B1 * | 6/2002 | Zelas et al. | 210/167.16 |
| 6,535,793 | B2 * | 3/2003 | Allard | 700/259 |
| 6,627,074 | B2 * | 9/2003 | Lincke | 210/167.17 |
| 7,786,381 | B2 * | 8/2010 | Henkin et al. | 174/68.1 |
| 8,364,309 | B1 * | 1/2013 | Bailey | 700/245 |
| 2003/0201218 | A1 * | 10/2003 | Henkin et al. | 210/169 |
| 2005/0156562 | A1 * | 7/2005 | Cohen | A47L 9/2857 320/107 |
| 2011/0049023 | A1 * | 3/2011 | Hui | 210/91 |

FOREIGN PATENT DOCUMENTS

| | | | | |
|---|---|---|---|---|
| FR | 2567552 | A1 | 1/1986 | |
| FR | 2934630 | A1 | 2/2010 | |
| WO | WO 2011038602 | A1 * | 4/2011 | E04H 4/16 |
| WO | 2013060984 | A1 | 5/2013 | |

OTHER PUBLICATIONS

Search Report dated Aug. 23, 2012 in French Application No. FR1103274.

International Search Report dated Feb. 8, 2013 in Application No. PCT/FR2012/052441.

Australian Patent Application No. 2012328263, First Examiner Report, mailed Jul. 28, 2016, 2 pages.

* cited by examiner

APPARATUS FOR CLEANING SUBMERGED SURFACES WITH A SEMI-AUTOMATIC RETURN COMMAND

CROSS-REFERENCE TO RELATED APPLICATIONS

This application claims the benefit of and claims priority to French Patent Application No. 11.03274 filed on Oct. 27, 2011, and to U.S. Provisional Application No. 61/599,051 filed on Feb. 15, 2012, the contents of both of which are incorporated herein by reference.

The invention relates to an automobile apparatus for cleaning surfaces submerged in a liquid, such as a surface formed by the walls of a basin, for example a swimming pool. The invention also relates to a control procedure of such an automobile apparatus.

Cleaning apparatus (for example, refer to FR 2 567 552) consisting of a hollow body; one or several guiding and driving mechanism(s) of the said hollow body on the submerged surface; and a pumping device driving a pumping unit such as a propeller generating a liquid output between at least one liquid inlet and one outlet from the hollow body, and passing through a filter chamber are known.

However, with all the submerged cleaning apparatus, the users face the same problem: removing the apparatus from the basin. As a matter of fact, these apparatus are submerged and, generally speaking, the users do not have the desire or the possibility to dive under the water to recover them. Moreover, such apparatus are sometimes totally standalone (in particular those that are powered by built-in batteries), and which thus have no link with the edge of the basin.

When, on the other hand, they are powered by an electric cable connected to the edge, the only possibility offered to the users is to pull the power cable in order to bring the apparatus back to them, and in particular, up to the surface along the edge in order to be able to catch hold of it. However, this method leads to premature wear and tear of the said cable, and hence to risks of electrocution.

Moreover, this method requires a significant degree of physical force and carries the risk of falling into the basin for weaker people (like children, elderly people, etc.).

Other cleaning apparatus (like FR 2 567 552 mentioned hereabove) give the user the opportunity to remotely control their movement under the water. However, this suggests that the user can accurately see the apparatus, which is not the case in deep basins, and/or in colored and/or especially dirty basins. Moreover, remotely controlling the robot up to the edge of the basin and up to the surface of the water is a tedious task.

The invention thus aims to mitigate these problems.

The invention aims to propose an automobile apparatus for cleaning surfaces submerged in a basin, whose return to the edge of the basin is made easy for a user.

The invention especially aims to propose such an apparatus that does not present any risk of wear and tear or risk of induced electrocution.

The invention also aims to propose such an invention whose return to the surface is rapid.

The invention thus relates to an automobile apparatus for cleaning surfaces submerged in a basin of water comprising:

- A hollow body,
- A driving mechanism,
- A programmed controlling device for the driving mechanism adapted to control the driving mechanism according to at least one cleaning program stored in a memory,

- A man-machine interface connected to the programmed device, and consisting of an input device,
- A filter chamber fitted in the said hollow body and having:
  - At least one liquid inlet in the hollow body,
  - At least one liquid outlet in the hollow body,
  - A hydraulic system for flow of liquid between each liquid inlet and outlet passing through a filtering mechanism, characterized in that

- The input device has at least one return command button,
- The man-machine interface is adapted, on manual activation of at least one return command button, to emit a signal representative of a predetermined set value, said to be a return setpoint,
- The programmed device is adapted, on receiving the return setpoint, to inhibit each cleaning program and to control the driving mechanism such that it drives the apparatus to the surface of the water.

The invention thus permits a semi-automatic return of the apparatus to the surface, that is to say a return in which the user carries out a minimum of operations (more particularly, he sends out a single instruction), and in which the apparatus manages its own return trajectory to the surface of the water. The launching of the phase of return to the surface is manual, but the return to the surface is ensured in an automatic manner by the apparatus.

The surface of the water covers the entire interface between the liquid contained in the basin and the external atmosphere.

From the time of receiving the return setpoint, the programmed controlling device controls the driving mechanism such that it drives the apparatus to the surface.

The driving mechanism based on the invention can be of different types suitable for enabling movement of the apparatus in the basin. It most advantageously comprises driving and guiding units and/or driving units and guiding units. Thus, an apparatus based on the invention could for example consist of wheels, tracks, a jet of water, etc. which may or may not be combined with the means of adapting the buoyancy of the apparatus, for example floats, ballasts, etc. The invention thus applies to automobile apparatus with electric or hydraulic propulsion.

However, the apparatus advantageously comprises units for driving and guiding through contact on a submerged surface. Thus, an apparatus based on the invention moves in particular on the floor and the walls of a basin. Such units are for example wheels or tracks.

Setpoint signals based on the invention can mainly be electric signals received through cable, or setpoint signals that are of the luminous type, radio frequencies, infrared, etc. and are thus received in a wireless manner.

A return setpoint based on the invention is a unique signal whose recognition by the programmed controlling device leads to the inhibition of the ongoing cleaning program by the programmed controlling device, and the start of the automatic control of the driving mechanism in the direction of a movement of the apparatus for its return to the surface.

Thus, the invention makes it possible to obtain, for the first time, an apparatus for cleaning surfaces submerged in a basin, whose return to the surface of the water is simple (all one needs to do is activate the input device of a man-machine interface), and rapid since the apparatus immediately interrupts any ongoing activity in the basin, to move itself based on a trajectory that brings it back to the surface of the water.

In particular, an apparatus based on the invention inhibits an operating program (and an associated path), especially a cleaning program, in order to comply with the order of return to the surface. The inhibition of the ongoing cleaning program at the time of receiving the return setpoint can be done in several ways: a termination of the program with a reset to zero for the next start, a temporary interruption of the program, pushing the program that is in progress to the background, but which—since the return setpoint takes priority—is not applied to the driving mechanism.

Whatever might be the ongoing cleaning program at the time that the return setpoint is received, the latter has the effect of inhibiting the control of the driving mechanism based on the cleaning program.

The trajectory adopted by the apparatus to return to the surface is not necessarily the most direct trajectory. Different strategies for return to the surface can be envisaged on receiving the return setpoint, especially depending on the nature of the driving mechanism.

However, the program for return to the surface is predetermined, stored in a memory of the apparatus, especially a memory of the programmed device, in such a way that the return to the surface is automatic and does not require any intervention of the user once the latter has manually launched this phase. Most of all, it does not require any remote control guiding of the apparatus.

Advantageously, a mechanism based on the invention is also characterized in that the programmed controlling device is adapted, on receiving the said return setpoint, to control the driving mechanism such that it brings back the apparatus along the edge of the basin.

Thus, an apparatus based on the invention does not come up to the surface of the water at any point of that surface: it advantageously comes up to the surface of the water along an edge of the said basin so as to enable a user to recover the apparatus from an edge (a border) of the basin without getting into the water.

Most of all, advantageously and based on the invention, the programmed controlling device is adapted, on receiving the said return setpoint, to control the driving mechanism such that it drives the apparatus straight up until it reaches the surface of the water.

More specifically, on receiving the said return setpoint, the programmed controlling device controls the driving mechanism such that it drives the apparatus straight up from a submerged surface, that is to say based on the most direct trajectory between its position at the time of receiving the said return setpoint, and an edge of the basin, based on its direction of movement at the time of receiving the said return setpoint.

However, nothing prevents the programmed controlling device from implementing a specific temporary program in response to an unexpected event (falling over a step, obstacle, uncontrolled movement, etc.) encountered on a return trajectory, which temporarily interrupts the program for return to the surface, which is resumed as soon as the handling of the event is terminated.

The straight up movement of an apparatus based on the invention means the direction in which the apparatus is driven without making a U-turn and without yaw steering, that is to say without any forced gyration around a normal axis to the submerged surface on which it is moving, such that the apparatus is controlled in a simple manner, and follows a direct trajectory in order to come out of the water.

In particular, in the case of such an apparatus equipped with a driving mechanism that is adapted to drive it by means of contact with a submerged surface (consisting of driving units such as wheels, tracks, etc.) the apparatus is driven based on a direct trajectory, that is to say along the intersection between an essentially vertical plane and the submerged surface, up to the point of intersection between the said plane and the edge situated in front of the apparatus in the direction of movement of the apparatus. Thus, the apparatus advantageously follows a trajectory that is essentially rectilinear, with the exception of changes in the orientation of the pitch based on the curves and the angles of the submerged surface, especially with the exception of the junction between a horizontal floor and a vertical wall.

Such an apparatus generally moves on the bottom surface of a basin during a cleaning program, such that, at the time of receiving the return signal, it follows a straight trajectory across the floor of the basin then, in the same alignment, a straight trajectory along a lateral wall of the basin.

Moreover, advantageously and based on the invention, the programmed controlling device is adapted to control the driving mechanism such that it maintains the apparatus on the surface of the water as soon as it is reached, until such time as a signal, said to be a stop signal, is received by the programmed controlling device.

Thus, an apparatus based on the invention remains waiting to be recovered by a user at the point on the surface at which it has come up.

Nothing prevents one from providing for a time-out period, beyond which the robot will go back down into the basin and resume a cleaning program.

A stop signal is a predetermined signal which, once it is received by the programmed controlling device, launches the shutting down of the driving mechanism by the programmed controlling device. Such a signal can be produced automatically by a detector, or manually by the user, for example by pressing a switch on the surface of the body of the apparatus.

However, advantageously and based on the invention, since the apparatus also comprises an accelerometer that is electrically connected to the programmed controlling device, the said stop signal is a signal emitted by the accelerometer.

An increasing number of apparatus for cleaning submerged surfaces possess at least one accelerometer connected to the programmed controlling device of the driving mechanism. In an apparatus based on the invention, such an accelerometer is advantageously utilized in order to detect the movement of the apparatus produced by a user when he removes the apparatus from the liquid. As a matter of fact, the viscosity of the liquid prevents abrupt accelerations of the apparatus, which are allowed as soon as it is no longer in a liquid, but in the air.

Thus, the driving mechanism is activated such that the apparatus remains on the surface of the liquid until such time as a user takes it out from the liquid.

Since an apparatus based on the invention also advantageously comprises:

An electric water pump fitted onto the hydraulic system so as to enable a liquid to flow between each liquid inlet and outlet while passing through a filtering mechanism, A power supply sensor for the said pump, that is electrically connected to the programmed controlling device, The said stop signal is a signal emitted by the power supply sensor of the said pump.

As a matter of fact, certain apparatus do not possess an accelerometer, and a simple and not very costly detection of the outflow of the water is carried out by measuring the power supply of the water pump: in fact, as soon as the apparatus is removed from the water, its hydraulic system empties itself, and the pump starts pumping air instead of water, the viscosities of which are very different from one another. Advantageously, the power supply sensor is a sensor of the feed current of the pump, because when the pump pumps air instead of water, the intensity of the power supply suddenly decreases.

Advantageously, an accelerometer and a power supply sensor for the pump can both be provided for, and the programmed controlling device can be programmed to stop the pump and the driving mechanism on receiving a stop signal from the accelerometer, or from the power supply sensor, or from both.

Moreover, advantageously and based on the invention, the programmed controlling device is adapted:

On receiving the return setpoint, to inhibit the ongoing cleaning program,

On prolonged receipt of the return setpoint, to control the driving mechanism such that it drives the apparatus in rotation in a predetermined direction, based on an axis that is substantially normal for the submerged surface where it is located, On receiving the stopping of the return setpoint, to control the driving mechanism such that it drives the apparatus up to the surface of the water.

In fact, certain basins and especially certain swimming pools have at least one portion of their edges that is not accessible to a user because of elements (wall, height, plants, etc.) that prevent access to it.

This is why the invention proposes an apparatus in which the point of the edge where the apparatus comes up to the surface can simply be chosen by a user. In particular, the invention proposes a single command to the user in order to choose the point of exit of the apparatus, and which does not involve complex phases of remote control of the apparatus on the part of the user. In particular, the apparatus based on the invention does not require manual guidance all along its exit path up to the surface.

In fact, advantageously and based on the invention, the user sends a return setpoint in a prolonged manner, which results in the rotation of the cleaning apparatus in relation to a normal axis to the submerged surface on which it is located. The user can maintain the emission of this return setpoint until the orientation of the apparatus enables him to pinpoint an area of the edge where he would like the apparatus to come out. When he interrupts the emission of the return setpoint, the programmed controlling device applies the automatic exit strategy of the apparatus as far as the surface of the water.

Advantageously and based on the invention, the input device consists of a single return command button.

An input device can be chosen from among different types: for example a physical keypad (with one or several buttons), a digital representation of such a keypad on a touchpad, etc. Moreover, it could be replaced by equivalent acquisition devices enabling the acquisition of a return command given by a user: a microphone to execute a voice input, a camera, an accelerometer, etc.

Advantageously and based on the invention, a single button on the input device leads to the emission of a return setpoint signal when it is activated. The said button is thus dedicated to this function.

Thus, an apparatus based on the invention is particularly simple to use for a user: the activation of a single button, which is always the same, enables him to order the apparatus to return to the surface. And advantageously, the prolonged activation of the same button enables a user to choose the point of return to the surface of the apparatus.

Moreover, advantageously an apparatus based on the invention also comprises a case that is adapted to be placed at the edge of the basin, with the said case being connected to the body by a cable that is adapted to be able to transmit at least a return setpoint to the programmed controlling device.

Such a case can include the man-machine interface, especially a return command button. It can also include some means of receiving (an antenna for example) a return setpoint sent out by a remote control, and transmission of this setpoint to the programmed controlling device.

The programmed controlling device can be on board the body of the apparatus and/or in the said case.

Moreover, such a case can be floating and connected by a cable to the body of the apparatus. In particular, such a floating case is pulled along by the apparatus and thus moves on the surface of the water when the apparatus moves in the basin. This case can be self-powered and even supply power to the cleaning apparatus, for example by being equipped with photovoltaic panels.

The case is connected to the cleaning apparatus by a cable. The same cable can be comprised of electric power supply wires for the apparatus.

Advantageously, an apparatus based on the invention also comprises a remote control consisting of the man-machine interface and a wireless transmitter adapted to be able to emit a signal representative of a return setpoint.

Thus, a user can be relatively far away from the basin when he sends the instruction for return to the surface to the apparatus by means of a remote control that emits the return setpoint thanks to a wireless transmission device for setpoint signals. Such a transmission device can use different types of radio frequency technologies (Bluetooth®, Wifi, etc.), infrared, etc. Most of all, nothing prevents one from using a mobile telephone or a computer as a remote control, with a specific application installed on the telephone (or the computer) enabling the display of a dedicated button and, on activation of this button, the formulation and sending of a signal representative of a return setpoint by one of its own means of wireless communication.

Advantageously and based on the invention, the case at the edge of the basin comprises an antenna for receiving signals emitted by the transmitter of the remote control. The case thus ensures a relay function between a wireless signal outside of the basin, and a wired signal in the basin.

Such an antenna could alternatively be in the body of the apparatus, or even in a floating case connected by cable to the apparatus.

It is advantageously in a case on the edge or in a floating case when the setpoint signals are wireless signals. In fact, the transmission of the majority of setpoint signals currently used for remote controls is weak in the water. On the other hand, it is not required when the apparatus is connected by a cable to a wired remote control.

The invention also extends to a control procedure for an automobile apparatus for cleaning surfaces submerged in a basin of water, with the said apparatus comprising:

A hollow body,

A driving mechanism,

A programmed controlling device for the driving mechanism adapted to control the driving mechanism according to at least one cleaning program stored in a memory, A man-machine interface consisting of at least one input device, A filter chamber fitted in the said hollow body and having:

At least one liquid inlet in the hollow body,

At least one liquid outlet in the hollow body,

A hydraulic system for flow of liquid between each liquid inlet and outlet passing through a filtering mechanism, characterized in that Since the input device has at least one return command button, one manually activates at least one return command button, On activation of a return command button, the man-machine interface emits a signal representative of a predetermined set value, said to be a return setpoint, On receiving the return setpoint, the programmed controlling device inhibits each cleaning program and controls the driving mechanism such that it drives the apparatus to the surface of the water.

Moreover, the invention extends to a computer program comprising instructions of computer code for executing such a procedure when it is loaded and executed on a computer driven terminal such as a mobile telephone or a computer.

The invention also relates to an apparatus for cleaning submerged surfaces, a control procedure and a computer program characterized in combination by all or part of the characteristics mentioned hereabove or herebelow.

Figure 2:
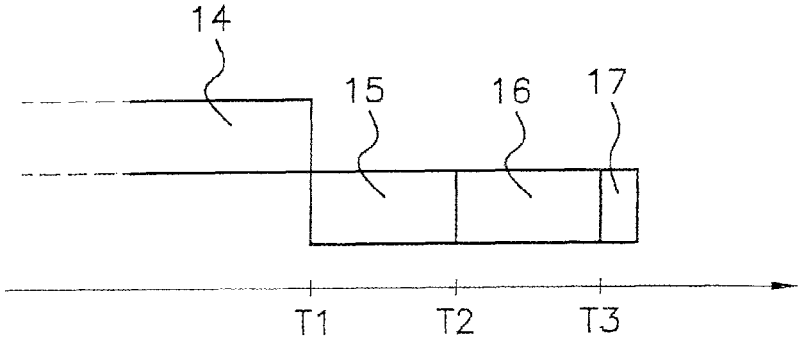
Figure 3:
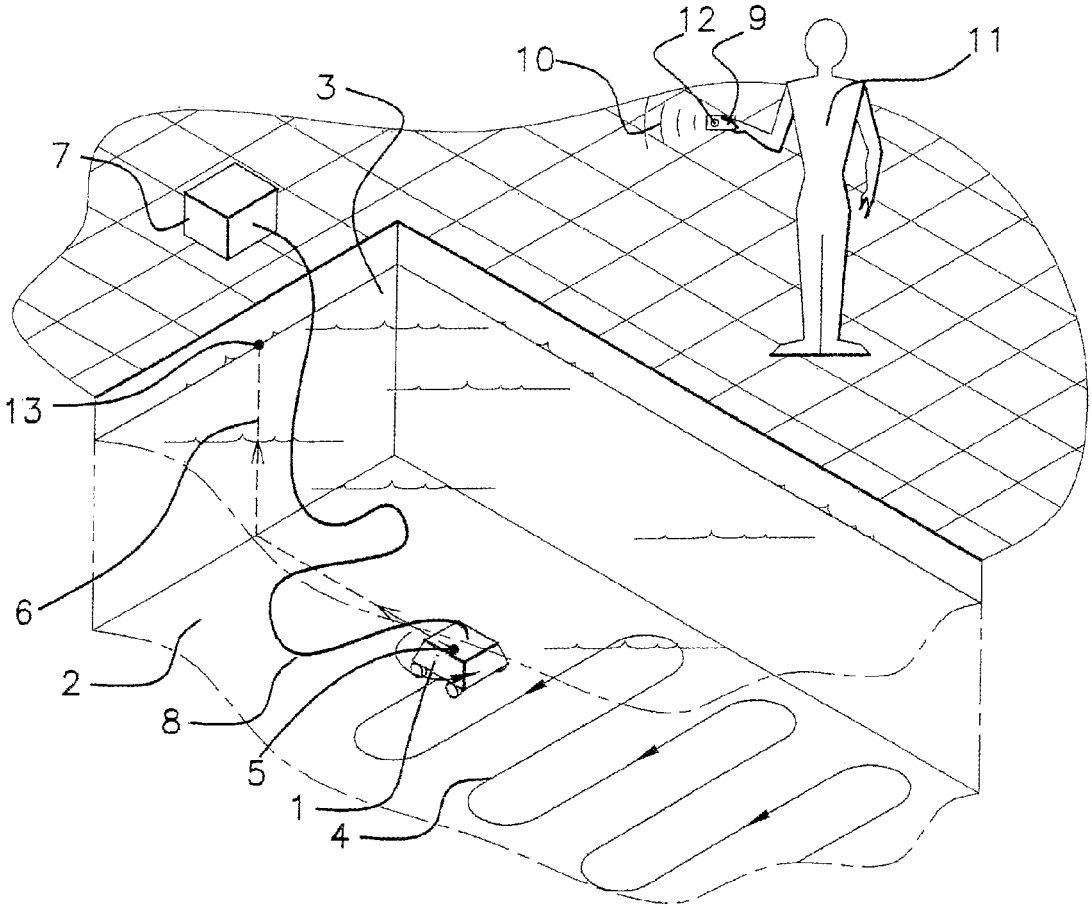
Figure 4:
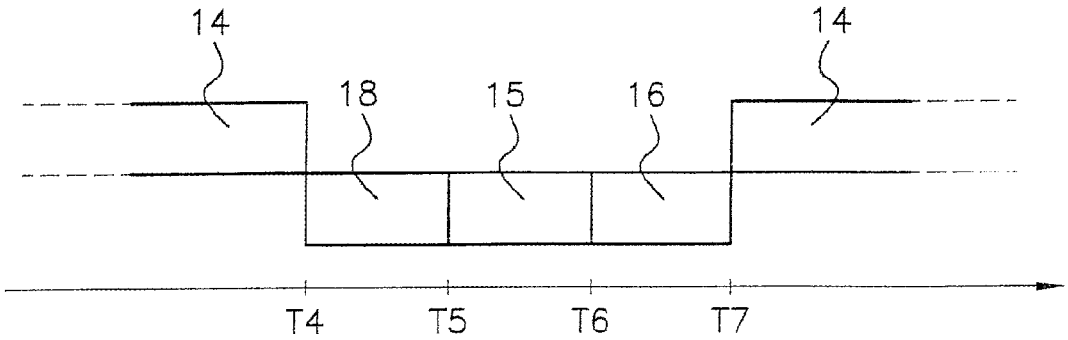

Other purposes, characteristics and advantages of the invention will come to light on reading the description given below that is non-exhaustive, and which refers to the annexed figures in which:

FIG. 1 is a schematic representation in perspective of a basin in which an automobile apparatus for cleaning submerged surfaces, based on a mode of construction that is in conformity with the invention, is submerged, FIG. 2 is a functional overview diagram of a mode of construction of a control procedure that is in conformity with the invention for the apparatus in FIG. 1, FIG. 3 is a schematic representation in conformity with FIG. 1 of the basin in which the automobile cleaning apparatus based on the invention is submerged, FIG. 4 is a functional overview diagram of a mode of construction of a control procedure that is in conformity with the invention for the apparatus in FIG. 3, The automobile apparatus 1 for cleaning submerged surfaces of a basin based on the mode of construction represented in FIGS. 1 and 3 is shown submerged in the water of a basin of a swimming pool 2, It relates to an electrical apparatus, that is to say one whose driving mechanism essentially comprises at least one electric motor connected to wheels in contact with a submerged surface so as to be able to move the apparatus on the said submerged surface.

Such an apparatus comprises moreover an internal filtration system (not shown) between a water inlet and outlet, on which is fitted at least one filtering mechanism. The flow of water in the filtration system is advantageously created by an electric pump.

The apparatus 1 is electrically connected by a cable 8 consisting of electric power supply wires, to a case 7 placed outside the basin. The said case 7 is advantageously connected to a power grid for distribution of electricity. Nothing, however, prevents the case from drawing its electric power from any other existing means (solar panels, wind turbine, generator, etc.).

Moreover, the case comprises an antenna (not shown) adapted so as to be able to receive wireless signals 10 from a remote control 9 which is itself adapted to be usable by a user 11. In particular, the antenna of the case 7 is adapted so as to receive signals 10 that are representative of a return setpoint.

The cable 8 comprises a wire that is dedicated to the transmission of signals between the case 7 and the apparatus 1, in particular between the antenna of the case 7 and a programmed controlling device for the driving mechanism of the apparatus, which is situated in the body of the apparatus 1. Alternatively, the signals between the antenna and the programmed controlling device can be transmitted by carrier waves along the electric supply wires of the cable 8.

The remote control 9 has at least one button 12 dedicated to the sending of return instructions. When the button 12 is activated, a wireless signal 10 that is representative of a return setpoint is emitted by a transmitter of the remote control. The button 12 cannot ensure any other functions, in particular, it does not allow the transmission of signals representative of a command that is different from the return setpoint. Thus, the button 12 for sending of the return setpoint is advantageously distinguishable, as one with a logo and/or a text affixed on the button or near it.

When the return setpoint is emitted by the transmitter of the remote control within a sufficiently close radius of the case 7, the antenna of the latter receives the return setpoint and transmits it by wire (via the cable 8) to the programmed controlling device of the apparatus.

The ongoing cleaning program implemented by the programmed controlling device before receiving this signal is inhibited, more specifically it is stopped, on receiving the return setpoint. As shown in FIGS. 1 and 3, the cleaning program before the receipt of the return setpoint corresponds to a trajectory, said to be a programmed trajectory 4, of the apparatus on one (or several) submerged surface(s) of the swimming pool 2.

On receiving the return setpoint, the programmed controlling device stops the cleaning program and controls the driving mechanism such that the apparatus comes up to the surface 3 of the basin. Thus, the programmed trajectory 4 pertaining to the normal cleaning program is abandoned at the point 5 of rotation and from this point onwards, a new trajectory, said to be the exit trajectory 6, is adopted.

Advantageously, the exit trajectory 6 is such that from the point 5 of rotation, the apparatus goes straight up, regardless of the submerged surfaces encountered, until it arrives at the surface 3 of the water. In particular, in FIG. 1, the apparatus first moves straight along a floor surface until it reaches a vertical wall, on which it extends its trajectory along the intersection between a vertical plane containing its trajectory along the floor surface.

When the apparatus arrives at the intersection of the plane previously mentioned, of the vertical wall along which the apparatus moves based on the exit trajectory 6, and the surface 3 of the water, at a point, said to be the point 13 of exit, the apparatus maintains itself in this position while waiting for a user 11. The apparatus can remain passive, that is to say idling at the point of exit 13, or it can keep its driving mechanism active depending on the nature of the apparatus (especially its buoyancy) and of its driving mechanism.

Similarly, when the apparatus comprises an accelerometer, one can plan to detect the arrival at the point of exit 13 thanks to the latter, and to adapt its functioning at this position (for example shutting down of a water pump and/or of the driving mechanism, or reducing the speed of driving, etc.) Similarly, a chronometer can be started, which enables the apparatus to return to a cleaning program at the end of a predetermined duration that is stored in memory.

The apparatus also comprises a three axis accelerometer that is electrically connected to the programmed controlling device. As long as the apparatus is in the water, the accelerations are small on account of the density of the water, which prevents heavy accelerations. However, once the apparatus comes out into the open air, heavy accelerations are possible. This is the case when a user recovers the apparatus from an edge of the swimming pool.

The accelerations that the apparatus is subjected to at the time of its removal from the swimming pool by a user are detected by the accelerometer, which sends the corresponding signals to the programmed controlling device.

Similarly, a sensor for measuring the intensity of the power supply of a water pump on board the apparatus detects that the pump is running at an abnormally high speed—generally a few seconds after the detection of the accelerometer: the time that the hydraulic system takes to empty itself of its water—and the signals corresponding to a low value of intensity of power supply are sent to the programmed controlling device.

When the programmed controlling device receives these signals, it stops at least the driving mechanism so as to avoid injuring the user and uselessly consuming more power. Advantageously, the programmed controlling device shuts down the entire apparatus including itself Thus, FIG. 2 presents a control procedure for an apparatus based on the invention, in particular an apparatus represented in FIG. 1, over time.

At the time T1 that the return setpoint is received, the ongoing cleaning program 14 is interrupted, regardless of what that program is. From the time of receipt of the return setpoint, the apparatus begins a return phase 15 corresponding to a return trip to the surface based on some predetermined instructions. Such automatic return instructions can be stored in a memory of the programmed controlling device.

At the time T2, the point of exit 13 to the surface of the water is reached and the apparatus puts itself in a waiting mode 16. For example, the wheels of the actuating device continue to turn at a reduced speed that is enough to maintain the apparatus close to the surface, if its average density is higher than that of the water.

Then at the time T3, the movement of recovering the apparatus by a user is detected by the accelerometer and/or the power supply sensor of the pump, and the programmed controlling device proceeds with the shutdown 17 of the apparatus.

FIG. 4 presents a control procedure for an apparatus based on the invention, in particular an apparatus represented in FIG. 3, over time.

At the time T4, the return setpoint is received, and the ongoing cleaning program 14 is interrupted. However, the return setpoint continues to be received by the apparatus, such that it enters into a phase 18 of rotation on the submerged surface on which it is located at the time of the first receipt (time T4) of the return setpoint.

Thus, as represented in FIG. 3, from the point 5 of rotation, a return trajectory 6 begins. This return trajectory 6 corresponds to a first phase 18 of rotation and then a phase 15 of automatic return as represented in FIG. 4. Thus, at the point 5 of rotation, the apparatus turns on itself on the submerged surface.

The user, by keeping the button 12 for sending the return setpoint pressed, can choose the point 13 of exit of the apparatus along the edge. The user can, in particular, easily choose the edge along which the apparatus is going to exit. In fact, by keeping the said button 12 activated, the apparatus turns on the submerged surface, and when the user releases the button 12, the apparatus comes straight up out of the basin. Thus, all that the user is required to do is press long enough on the button 12 such that the robot is oriented in the right direction. This relates to a semi-automatic exit of the apparatus, because the user is not required at any time to determine the trajectory of the apparatus. In particular, as long as he keeps the button 12 pressed, the apparatus turns in a predetermined direction that the user cannot choose. Similarly, in the case of an obstacle along the most direct trajectory chosen by the user, the apparatus automatically reorganizes its return trajectory, and arrives advantageously at a point close to the point of exit 13 desired by the user.

At the time T5, the apparatus still finds itself at the point 5 of rotation, but is differently oriented, and the apparatus detects that it is no longer receiving the return setpoint. It thus passes from a phase 18 of rotation to a phase 15 of return in a straight line as far as the surface.

At the time T6, the point 13 of exit to the surface is reached, and the apparatus puts itself in a waiting mode 16. A chronometer is started for example at the time of arrival at the point 13 of exit detected by the accelerometer.

At the time T7, no signal of recovery by a user has been detected coming from the accelerometer or from the power supply sensor of the pump since the time T6. The programmed controlling device thus goes back to a cleaning program 14 (whose associated trajectory for the apparatus in the swimming pool is not represented in FIG. 3). The maximum waiting period (between T6 and T7) is predetermined and stored in a memory of the programmed controlling device.

The invention can be the subject of numerous other alternatives for construction that are not represented here.

Nothing prevents for example the antenna for receiving the return setpoints from being placed for example inside the body of the cleaning apparatus, even if the same is submerged and communicates wirelessly with a remote control being used as the man-machine interface. Neither does anything prevent it from being mounted on board a floating case on the surface of the water, connected by a cable to the cleaning apparatus, with the floating case being capable of being self-powered for example through photovoltaic panels on board. Numerous other modes of construction can be envisaged.

Moreover, an apparatus based on the invention can comprise several electronic control boards that can form the said programmed controlling device, including electronic boards (PCBs) distributed between the apparatus and the case 7.

Similarly, an apparatus based on the invention can comprise multiple different types of driving mechanisms, for example, wheels motorized by an electric motor powered by a cable connecting the apparatus to the edge of the basin and enabling it to move on the submerged surfaces, and at the same time, a jet of water created by an on board or external water pump that enables it for example to follow vertical trajectories in the basin.

Moreover, the remote control based on the invention can be of different types: wireless or wired remote control, with buttons or touchpad, etc. It can also be a dedicated remote control for the cleaning apparatus, or be a mobile telephone, a computer, etc.

Moreover, an apparatus based on the invention may not have a remote control, with the entire man-machine interface being handled at the level of a case at the edge of the basin, with the latter having in particular a button dedicated to the function of semi-automatic return of the apparatus to the edge of the basin.

Neither does anything prevent the invention from being combined with the means of remote controlling the trajectory of the apparatus. In fact, the advantage of the invention remains the simple semi-automatic control of the return of the robot.

Moreover, the apparatus can move around in circles or turn on itself during the phase 18 of rotation at the point 5 of rotation.

The invention is applicable to all types of apparatus for cleaning submerged surfaces, whatever might be their normal cleaning program.

The invention claimed is:

1. Automobile apparatus for cleaning surfaces submerged in a basin of water comprising:

a body, a driving mechanism, a programmed controlling device for the driving mechanism adapted to control the driving mechanism according to at least one cleaning program stored in a memory, a man-machine interface connected to the programmed controlling device, and comprising an input device, a filter chamber fitted in the body and having:

at least one liquid inlet in the body, at least one liquid outlet in the body, a hydraulic system for the flow of liquid between each inlet and outlet of liquid passing through a filtering mechanism, and in which the input device has at least one return command button on manual activation of the at least one return command button, the man-machine interface is adapted to emit a signal representative of a predetermined set value, said to be a return setpoint, on receiving the return setpoint, the programmed controlling device is adapted to inhibit each cleaning program and control the driving mechanism such that it drives the body to the surface of the water and maintains the body at the surface of the water until a stop signal is present, further comprising an accelerometer that is electrically connected to the programmed controlling device and emits a signal on which the stop signal is based.

2. Automobile apparatus for cleaning surfaces submerged in a basin of water comprising:

a body, a driving mechanism, a programmed controlling device for the driving mechanism adapted to control the driving mechanism according to at least one cleaning program stored in a memory, a man-machine interface connected to the programmed controlling device, and comprising an input device, a filter chamber fitted in the body and having:

at least one liquid inlet in the body, at least one liquid outlet in the body, a hydraulic system for the flow of liquid between each inlet and outlet of liquid passing through a filtering mechanism, and in which the input device has at least one return command button on manual activation of the at least one return command button, the man-machine interface is adapted to emit a signal representative of a predetermined set value, said to be a return setpoint, on receiving the return setpoint, the programmed controlling device is adapted to inhibit each cleaning program and control the driving mechanism such that it drives the body to the surface of the water and maintains the body at the surface of the water until a stop signal is present, further comprising:

an electric water pump fitted onto the hydraulic system so as to enable a liquid to flow between each liquid inlet and outlet while passing through a filtering mechanism, a power supply sensor for the said pump, that is electrically connected to the programmed controlling device, the said stop signal is based on a signal emitted by the power supply sensor of the said pump.

3. A system for cleaning a swimming pool, comprising:

a. an automatic swimming pool cleaner comprising:

i. a body defining a liquid inlet and a liquid outlet and a driven cleaning member;

ii. a mechanism for driving the body within a swimming pool having a floor surface and a generally-vertical wall intersecting the floor surface; and iii. a control device associated with the body; and b. an input device (i) remote from the automatic swimming pool cleaner and (ii) comprising means for transmitting a return signal directly or indirectly to the control device so as to (A) inhibit cleaning operation of the driven cleaning member of the automatic swimming pool cleaner and (B) control the driving mechanism, while the cleaning operation is inhibited, such that the driving mechanism both drives the automatic swimming pool cleaner along the floor surface to the intersection with the generally-vertical wall and thence drives the automatic swimming pool cleaner up the generally-vertical wall to a surface of water in the swimming pool so as to position at least part of the automatic swimming pool cleaner above the surface of water for removal from the swimming pool.

4. A system according to claim 3 in which the signal-transmitting means of the input device comprises a wireless signal transmitter.

5. A system according to claim 3 in which the return signal transmitted by the signal-transmitting means of the input device further controls the driving mechanism, while the cleaning operation is inhibited, to maintain at least part of the automatic swimming pool cleaner above the surface of the water until (a) the automatic swimming pool cleaner is removed from the swimming pool, (b) a stop signal is received by the control device, or (c) a time-out period has occurred.

6. A system according to claim 3 in which the return signal transmitted by the signal-transmitting means of the input device further controls the driving mechanism, while the cleaning operation is inhibited, to rotate the automatic swimming pool cleaner on the floor surface about an axis normal to the floor surface.

7. A system according to claim 3 in which the input device comprises an activator dedicated to transmitting only the return signal.

8. A system according to claim 3 in which the return signal is a single instruction configured to inhibit cleaning operation of the driven cleaning member of the automatic swimming pool cleaner and control the driving mechanism, while the cleaning operation is inhibited, such that the driving mechanism both drives the automatic swimming pool cleaner along the floor surface to the intersection with the generally-vertical wall and thence drives the automatic swimming pool cleaner up the generally-vertical wall to a surface of water in the swimming pool so as to position at least part of the automatic swimming pool cleaner above the surface of water for removal from the swimming pool.

9. A system for cleaning a swimming pool, comprising:

a. an automatic swimming pool cleaner comprising:

i. a body defining a liquid inlet and a liquid outlet and a driven cleaning member;

ii. a mechanism for driving the body within a swimming pool having a floor surface and a generally-vertical wall intersecting the floor surface; and iii. a control device associated with the body; and b. an input device (i) remote from the automatic swimming pool cleaner and (ii) comprising means for transmitting a return signal directly or indirectly to the control device so as to (A) inhibit cleaning operation of the driven cleaning member of the automatic swimming pool cleaner and, while the cleaning operation is inhibited, (B) control the driving mechanism such that the driving mechanism (1) rotates the automatic swimming pool cleaner on the floor surface about an axis normal to the floor surface, (2) drives the automatic swimming pool cleaner along the floor surface to the intersection with the generally-vertical wall and thence drives the automatic swimming pool cleaner up the generally-vertical wall to a surface of water in the swimming pool so as to position at least part of the automatic swimming pool cleaner above the surface of water for removal from the swimming pool, and (3) maintains at least part of the automatic swimming pool cleaner above the surface of the water until (a) the automatic swimming pool cleaner is removed from the swimming pool, (b) a stop signal is received by the control device, or (c) a time-out period has occurred.

10. A system according to claim 9 in which the signal-transmitting means of the input device comprises a wireless signal transmitter.

* * * * *